US006508627B2

(12) United States Patent
Gerken et al.

(10) Patent No.: US 6,508,627 B2
(45) Date of Patent: Jan. 21, 2003

(54) AIRFOIL BLADE AND METHOD FOR ITS MANUFACTURE

(75) Inventors: Mark Allen Gerken, Union, OH (US); Michael Joseph Neely, Beavercreek, OH (US); Michael Brendel, Centerville, OH (US); James L. E. Meats, Oakwood, OH (US)

(73) Assignee: Lau Industries, Inc., Dayton, OH (US)

( * ) Notice: Subject to any disclaimer, the term of this patent is extended or adjusted under 35 U.S.C. 154(b) by 0 days.

(21) Appl. No.: 09/870,367

(22) Filed: May 30, 2001

(65) Prior Publication Data

US 2002/0182079 A1 Dec. 5, 2002

(51) Int. Cl.[7] ..... F04D 29/30

(52) U.S. Cl. ..... 416/186 R; 416/214 R; 416/223 B; 29/889.4; 29/889.72

(58) Field of Search ..... 416/185, 214 R, 416/214 A, 232, 234, 223 B, 186 R; 29/889.21, 889.4, 889.72

(56) References Cited

U.S. PATENT DOCUMENTS 3,480,373 A * 11/1969 Talbot ..... 29/889.72
3,694,881 A * 10/1972 Glucksman ..... 29/889.4
4,191,506 A 3/1980 Packham
4,662,819 A * 5/1987 Lakowske et al. ..... 415/129
4,971,521 A * 11/1990 Atarashi et al. ..... 29/889.72
5,401,138 A 3/1995 Mosiewicz
5,558,499 A * 9/1996 Kobayashi ..... 416/186 R
5,743,708 A 4/1998 Cunha et al.
5,873,699 A 2/1999 Watson et al.
5,927,130 A 7/1999 Watson et al.
5,993,156 A 11/1999 Bailly et al.

FOREIGN PATENT DOCUMENTS

JP 62-14397 4/1987
JP 401277603 A 11/1989

* cited by examiner

*Primary Examiner*—Edward K. Look
*Assistant Examiner*—Ninh Nguyen
(74) *Attorney, Agent, or Firm*—Calfee Halter Griswold, LLP

(57) ABSTRACT

This centrifugal blower fan wheel has extruded-aluminum airfoil blades. The preferred blades have two hollow regions, separated by an angled mid-load support beam, inside the blade. The nose section of the blade (at the leading edge) and the tail section of the blade (at the trailing edge) have open semi-circular grooves which face the adjacent hollow sections and are designed to accept thread cutting or thread forming screws for attachment of the blade to a ring-shroud and back-plate.

17 Claims, 3 Drawing Sheets

AIRFOIL

BACKWARD CURVED

BACKWARD INCLINED

RADIAL TIP

FORWARD CURVED

RADIAL BLADE

AIRFOIL BLADE AND METHOD FOR ITS MANUFACTURE

TECHNICAL FIELD

This invention relates to airfoil blades, especially blades for centrifugal blowers, and to methods for their manufacture

BACKGROUND

The air moving performance of a fan is characterized by the static pressure rise it produces across a range of airflow rates. The curve illustrating the fan pressure rise as a function of flow rate is referred to as the fan characteristic. A typical centrifugal fan characteristic is shown in FIG. 1.

To perform properly, a fan must be matched to its application, or system, at the intended flow-pressure point of operation. The system comprises elements such as ducts, elbows, expanding or converging transitions, heating and cooling coils, screens and guards, dampers, louvers, shutters, nozzles, filters, or bubble pools, all of which produce resistance to airflow. The fan must be designed or specified such that the fan static pressure rise is equal to the sum of the system resistances. The fan operating point is defined as the intersection of the fan and system characteristics, as shown in FIG. 1.

The static pressure rise required for a given application dictates the type of fan to be used. Axial flow fans produce relatively high volume flow rates and relatively low static pressure rise. Centrifugal fans are suited to higher pressure rise applications. The rotating component, or wheel, of a centrifugal fan has a series of blades classified by their curvature and cross section. Of the blade types commonly used today, the airfoil, or AF, blade is the most efficient, and if operated at or near its point of maximum efficiency, has the lowest noise level.

Unfortunately, present airfoil blades are relatively expensive, compared to other types of blades. Backward-curved, backward-inclined, radial-tip, forward-curved, and radial blades all can be produced using simple metal forming operations. The airfoil blade, however, requires additional manufacturing operations, such as bending of a metal plate about a form or pattern. Furthermore, the airfoil blade in most commercial applications is attached to the back plate and ring shroud with a welded bead. These difficult and labor-intensive manufacturing processes often make the cost of the airfoil wheel prohibitive for many customers.

In the contemporary regulatory environment, fan noise and efficiency are receiving increased scrutiny. ASHRAE standards for example, sets limits on the fan power consumption per unit flow rate. Regulations limiting noise are causing fan and HVAC equipment manufacturers to seek improved fan designs, and the increased cooling loads from computers and other electronic equipment have placed enormous demands on air conditioning systems. All of these applications require high efficiency, low noise fans, but contractors and consumers are reluctant to pay the high prices charged for traditional airfoil centrifugal fans.

Japanese Utility Model Publication 62-1437, published on Apr. 13, 1987 to the Japanese Air Conditioned Technical Research Institute for an invention by Eisuke Nishizu, referenced in U.S. Pat. No. 4,971,521, discloses one attempt to solve these problems. Nishizu's centrifugal blower has extruded airfoil blades, mounted with screws extending through end rings and a back plate into female screw holes in screw fastening portions mounted in ribs extending from the upper skin of the blade to its lower skin.

Unfortunately, the Nishizu design has some shortcomings.

Placing the female screw holes in central ribs means that at least two ribs are required, which means there will be at least three longitudinal cavities through the extrusion. This is contrary to conventional extrusion practice, which seeks to minimize the number of openings in the extrusion. Placing the screw receptors in the cross-ribs also complicates the design and manufacture of the extrusion die(s).

Having all three openings face toward the tail of the blade helps the blade resist forces on the front of the blade, but weakens the mounts with respect to forces that press the blade forward, such as the momentum of the blade if the wheel comes to a sudden stop. Incorporating the screw receptors in the cross ribs moves the screws toward the center of the blade, which increases the torque on the connections from off-center loads.

SUMMARY OF THE INVENTION

The invention disclosed herein provides a centrifugal fan wheel with extruded aluminum airfoil blades. The blade extrusion is of the "semi-hollow" type, which can be manufactured inexpensively by producing long "strips" of blades that are cut to the desired length. In the preferred embodiment, two hollow regions, separated by an angled mid-load support beam, characterize the inside of the blade. The nose section of the blade (at the leading edge) and the tail section of the blade (at the trailing edge) have open semi-circular grooves in the nose and tail sections, facing the adjacent hollow sections and designed to accept thread cutting or thread forming screws, for attachment of the blade to a ring-shroud and back-plate.

Aluminum extruding is a widely used process, and extruded-aluminum parts are found in many consumer and industrial products. An extrusion die is a relatively low-cost piece of tooling, and holds up well over time, experiencing little wear over a production run of thousands of feet of material. Extruded blade strips can be cut to the desired blade span, allowing wheels of varying widths to be manufactured with little difficulty.

In addition to low-cost tooling and ease of manufacturing, the extruded blade can be designed with internal features, such as bolt holes and structural elements, as described below.

The attachment of the blade with thread cutting or thread forming screws or bolts eliminates the difficulty and cost that is usually associated with this type of wheel. Typical airfoil wheels with large diameters are constructed by welding the blade ends to a front blade support, typically called the ring shroud, and to a rear blade support, typically called the back plate (or center disk, in double-width wheel applications). The semi-hollow extrusion die allows semi-circular holes to be incorporated into the blade interior. These holes are sized in such a way a to facilitate the blade attachment to other components using thread cutting or thread forming screws. In a prototype sample of the invention, aluminum 6061-T6 was used for the blade material, and the required hole diameter tolerance for thread cutting or thread forming screws was maintained. Furthermore, both the drive torque and tightening torque fell within the acceptable range typically specified for this type of screw.

Commercial centrifugal fans are subject to very high structural loads, which sometimes require that supports such as braces, support rings, or other devices be attached to the wheel. Without such support structures, the blade is fixed only at its ends, at the blade-to-ring shroud and blade-to-back-plate attachment points. At the blade mid-chord, mid-span location, farthest from the attachment points, the centrifugal forces give rise to large stress and deflection of the blade.

The extruded-blade construction allows a variety of internal features to be integrated into the airfoil-blade design. Using finite-element analysis (FEA) of the structural loads on the blade, we decided to add a mid-chord structural support beam to the airfoil cross section, connecting the pressure and suction sides of the hollow blade. The effectiveness of the beam is increased by angling it slightly, such that it is substantially aligned with the radial force vector imposed by the centrifugal load. In practice, the designer would set the pitch angle of the blade for the desired air moving performance, and align the beam with a straight line connecting the wheel center of rotation with the mid-chord location of the airfoil.

In summary, a low-cost, high-efficiency, and low-noise centrifugal fan airfoil (AF) blade has been invented. The blade is suitable for use in both single- and double-width centrifugal wheels. The unique design, featuring extruded-aluminum construction, an integral structural support beam, and semi-circular holes for blade attachment with thread cutting or thread forming screws, represents a simple, low-cost alternative to traditional AF centrifugal fan blades.

Other features and advantages of this invention will be apparent from the following detailed description.

DRAWINGS

Figure 3A:
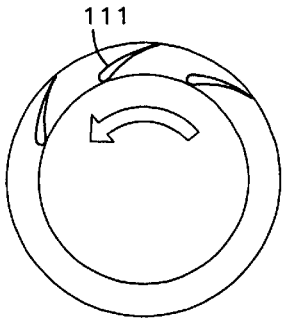
Fig.3A (PRIOR ART)

FIG. 3*a* illustrates an airfoil type prior art fan blade.

Figure 3B:
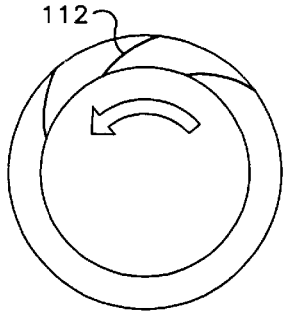
Fig.3B (PRIOR ART)

FIG. 3*b* illustrates a backward curved type prior art fan blade.

Figure 3C:
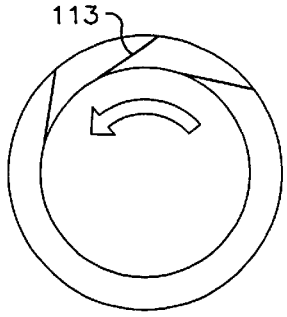
Fig.3C (PRIOR ART)

FIG. 3*c* illustrates a backward inclined type prior art fan blade.

Figure 3D:
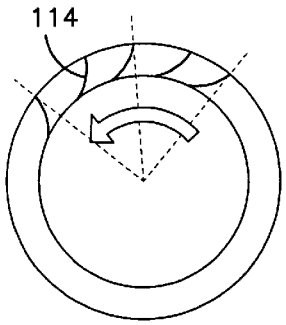
Fig.3D (PRIOR ART)

FIG. 3*d* illustrates a radial tip type prior art fan blade.

Figure 3E:
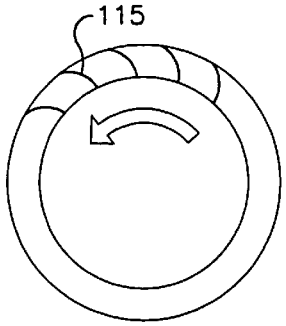
Fig.3E (PRIOR ART)

FIG. 3*e* illustrates a forward curved type prior art fan blade.

Figure 3F:
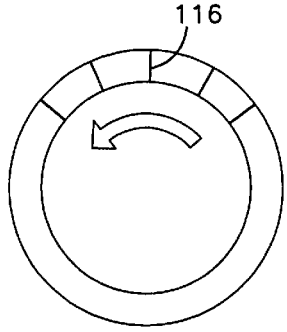
Fig.3F (PRIOR ART)

FIG. 3*f* illustrates a radial blade type prior art fan blade.

Figure 4A:
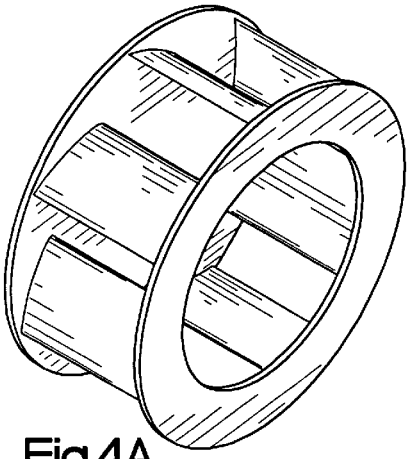
Figure 4B:
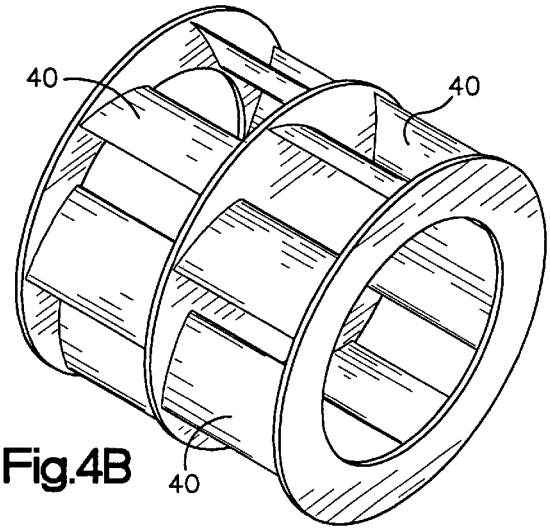

FIGS. 4*a* and 4*b* are, respectively, perspective views of single-width and double-width fans embodying this invention.

Figure 5:
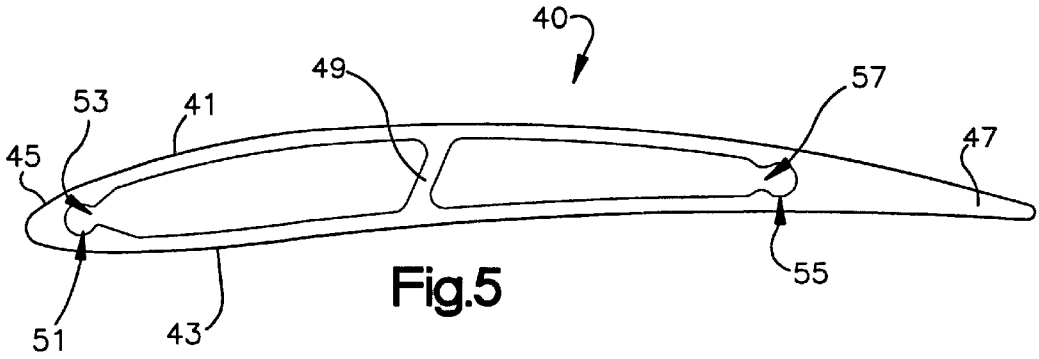

FIG. 5 is a cross-sectional view of an airfoil blade embodying this invention.

Figure 6:
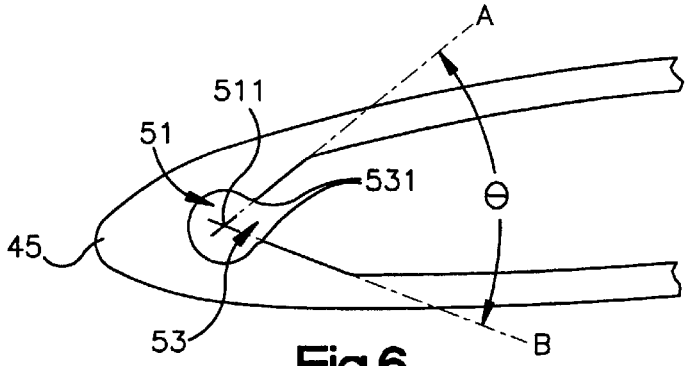

FIG. 6 is an enlarged, fragmentary cross-sectional view from the same viewpoint as FIG. 5.

Figure 7:
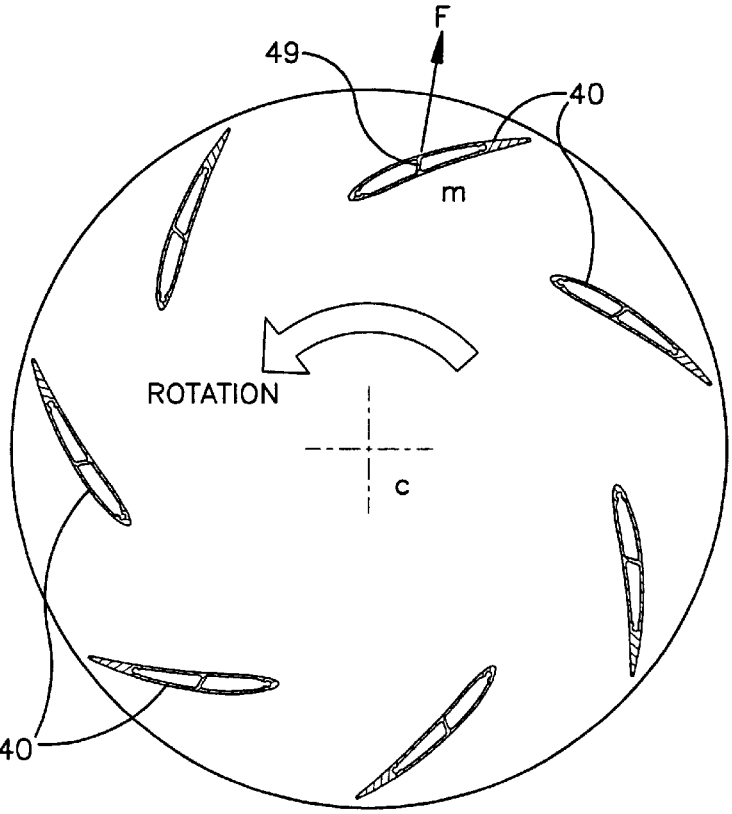

FIG. 7 is a cross-sectional view of a blower fan with blades of this invention.

DETAILED DESCRIPTION

Figure 1:
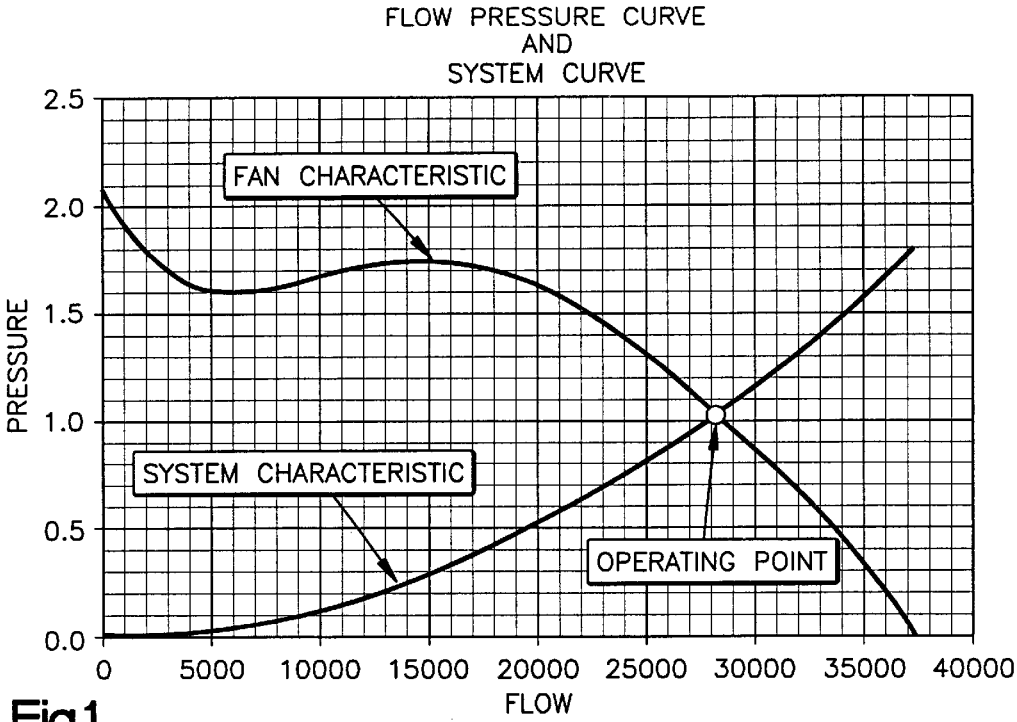
FIG. 1 is a graph of fan and system characteristics for a typical centrifugal fan installation.
Figure 2:
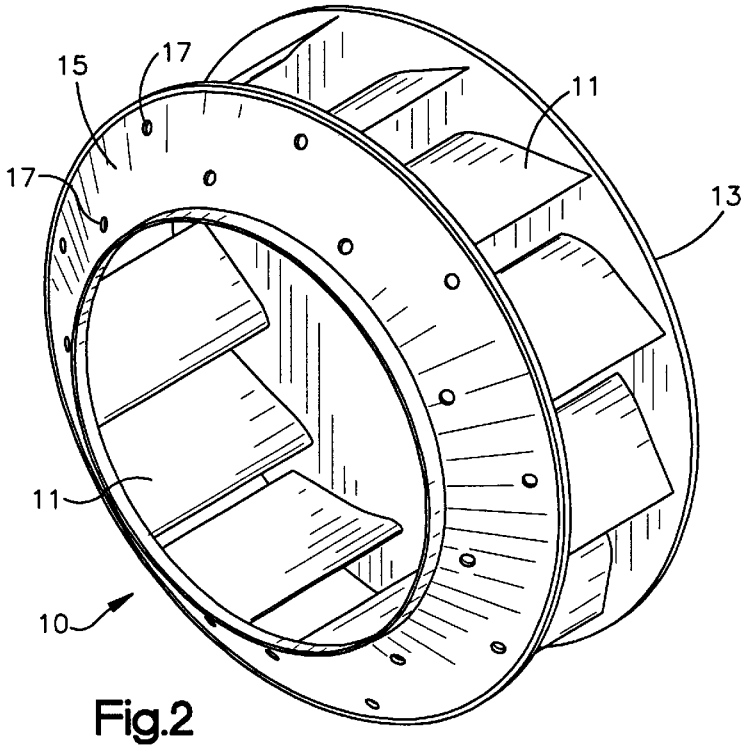
FIG. 2 is a perspective view of a centrifugal fan embodying this invention.

FIG. 2 illustrates a centrifugal blower, referred to generally as 10, with blades 11 mounted between a back plate 13 and a front ring shroud 15 with a central air inlet. The blades of this invention, which are shown in more detail in FIGS. 5 and 6, may be attached with thread cutting or thread forming screws 17 through the ring-shroud 15, as shown in FIG. 2, and through the back-plate.

As noted above, prior art centrifugal blowers employ a variety of blade types, which are illustrated in more detail in FIG. 3. The most common types include the airfoil blade 111, the backward curved blade 112, the backward inclined blade 113, the radial tip blade 114, the forward curved blade 115, and the radial blade 116. The airfoil blade is the most efficient, and has the lowest noise level if operated at or near its point of maximum efficiency. However, conventional methods for manufacturing and installing these blades are difficult and labor-intensive. This often makes the cost of an airfoil wheel prohibitive for many customers. This invention significantly reduces the cost of manufacturing and installing airfoil blades, and makes centrifugal blower wheels with these blades economically attractive for many additional installations.

FIG. 5 is a cross-section of a typical extruded airfoil blade embodying this invention. It is extruded from conventional aluminum extrusion alloys, such as 6061T6 or 6063T6, in lengths of ten to twenty feet. These long extrusions are then sliced to form the individual blades, typically four to twelve inches long.

The illustrated airfoil blade, generally referred to as 40, has a upper skin 41 and a lower skin 43, both of which extend from a nose section 45 to a tail section 47. As may be seen in FIG. 5, the nose section and the tail section are significantly thicker than the upper and lower skin. A central structural support beam 49, also formed in the extrusion process, helps provide rigidity. With an exceptionally wide blade (from nose to tail) two support beams might be desirable for increased stiffness. And with a much narrower blade one might want to eliminate the central support beam and produce a blade with only one central cavity, which would simplify extrusion. However, for the vast majority of applications we believe that the illustrated blade with one central support beam will strike the optimal balance between structural rigidity and ease of manufacture.

As may also be seen in FIG. 5, airflow blades of this invention also have an opening 51 for a thread cutting or thread forming screw and a similar opening 55 for a thread cutting or thread forming screw in the tail section 47. These openings are also produced in the extrusion process, which significantly reduces manufacturing costs. The openings have longitudinal mouths 53, 57 which are open to facilitate extrusion but narrowed to retain the thread cutting or thread forming screws 17 illustrated in FIG. 2. As seen in FIG. 5, openings 51 and 55 face each other. Thus, any force that tends to push the blade off one of the screws will just set the blade more firmly on the other screw.

The optimal width of mouth 53 and mouth 57 may vary from installation to installation. In general, we believe that a preferred balance between various factors may be achieved when two lines "A" and "B" from the axis 511 of one of the longitudinally extending extruded grooves across the lips 531 of the mouth define an arc $\Theta$ of about 55° to about 65°, as illustrated in FIG. 6 The preferred material of construction may also vary. Satisfactory structures may be manufactured with a wide range of conventional aluminum extrusion alloys, including stronger alloys such as 6061T6 and more extrudable alloys such as 6063T6.

Typical blades may be mounted with ¼" thread-cutting or thread-forming screws. For use with ¼" thread-cutting screws, which are generally preferred, openings 51 and 55 may be between about 0.214" and about 0.228" in diameter. As shown in FIGS. 5*a* and 5*b*, centrifugal blowers with blades of this invention may be constructed in either single widths, as shown in FIG. 4*a*, or in double widths, as shown in FIG. 4*b*. In the double-width wheel, the blades 40 are preferably offset to provide access to screw connections and for noise reduction.

FIG. 7 is a cross-sectional view of a centrifugal wheel with the airflow blades 40 of this invention, illustrating the positioning of the central support beam 49. It is preferably aligned substantially radially with respect to the axis of the wheel, and placed substantially at the center of mass of the blade. In this position the central support beam 49 is substantially aligned with the centrifugal force vector F that arises from the blade mass rotating about the center of the wheel.

As may be seen from the foregoing description and the accompanying drawings, the airfoil blades of this invention have all of the functional and structural advantages of prior art airfoil blades. The factor that sets them apart is the ease and economy with which they can be manufactured and installed. This makes them highly desirable for many installations whose designers might have made do with inferior blades in the past. Of course, those skilled in the art will readily appreciate that many modifications may be made in the structures disclosed above. The foregoing description is merely illustrative, and is not meant to limit the scope of this invention, which is defined by the following claims.

We claim:

1. A fan blade comprising:

a hollow extrusion having an upper skin with a thickness and a lower skin with a thickness;

each of said skins extending from a nose section to a tail section;

said nose section having a thickness greater than the thickness of said upper skin and greater than the thickness of said lower skin;

said nose section comprising a first longitudinal, extruded groove with a first narrowed open, longitudinally extending mouth;

said tail section having a thickness greater than the thickness of said upper skin and greater than the thickness of said lower skin;

said tail section comprising a second longitudinal, extruded groove with a second narrowed open, longitudinally extending mouth; and said first and second grooves and said first and second mouths being designed and adapted to retain fasteners within said grooves, and being designed to facilitate forming of said grooves and said mouths during extrusion of said blade.

2. A blade according to claim 1 wherein said first extruded groove faces toward said tail section and said second extruded groove faces toward said nose section.

3. A blade according to claim 1 wherein said extrusion comprises aluminum.

4. A blade according to claim 3 wherein said aluminum comprises alloy 6061T6 or alloy 6061T6.

5. A centrifugal blower wheel comprising:

a rear blade support;

a front blade support; and a series of extruded airfoil blades spaced between said rear blade support and said front blade support, said blades comprising:

hollow extrusions having an upper skin with a thickness and a lower skin with a thickness;

each of said skins extending from a nose section to a tail section;

said nose section having a thickness greater than the thickness of said upper skin and greater than the thickness of said lower skin;

said nose section comprising a first longitudinal, extruded groove with a first narrowed, open, longitudinally extending mouth;

said tail section having a thickness greater than the thickness of said upper skin and greater than the thickness of said lower skin;

said tail section comprising a second longitudinal, extruded groove with a second narrowed, open, longitudinally extending mouth; and said first and second grooves and said first and second mouths being designed and adapted to retain fasteners within said grooves, and being designed to facilitate forming of said grooves and said mouths during extrusion of said blades.

6. A blade according to claim 5 wherein said first extruded groove faces toward said tail section and said second extruded groove faces toward said nose section.

7. A blower wheel according to claim 5 wherein said blades are secured to said front support and said back support with thread cutting or thread forming screws extending through said front support into said grooves and additional thread cutting or thread forming screws extending through said back support into said grooves.

8. A blower wheel according to claim 5 wherein said first longitudinally extending mouth comprises an arc of about 55° to 65° about a longitudinal axis of said first longitudinal, extruded groove.

9. A blower wheel according to claim 8 wherein said second longitudinally extending mouth comprises an arc of about 55° to about 65° about a longitudinal axis of said second longitudinal, extruded groove.

10. A method for making an airfoil blade comprising:

extruding an aluminum member with an upper skin, a lower skin, a nose section and a tail section, with at least one hollow bore defined by said upper skin, lower skin, nose section and tail section;

forming a first longitudinal, extruded groove with a first narrowed, open, longitudinally extending mouth in said nose section as said member is extruded;

forming a second longitudinal, extruded groove with a second narrowed, open, longitudinally extending mouth in said nose section as said member is extruded;

slicing said member to length to form individual blades.

11. A method according to claim 10 wherein said first longitudinally extending mouth comprises an arc of about 55° to about 65° about a longitudinal axis of said first longitudinal, extruded groove.

12. A blower wheel according to claim 11 wherein said second longitudinally extending mouth comprises an arc of about 55° to about 65° about a longitudinal axis of said second longitudinal, extruded groove.

13. A method of manufacturing a centrifugal blower wheel comprising:

providing a rear blade support with a plurality of spaced fastener holes;

providing a front plate support with a plurality of fastener holes;

providing airfoil blades having extruded mounting holes;

attaching said blades to said rear blade support and said front blade support with thread cutting or thread forming screws extending through said fastener holes into said mounting holes.

14. A method according to claim 13 wherein said blades are manufactured by extruding a metallic member and cutting said members to length to form individual blades, and said fastener holes comprise open mouthed, longitudinally extending grooves, said grooves being formed as said member is extruded.

15. A fan blade comprising:

a hollow extrusion having an upper skin and a lower skin;

each of said skins extending from a nose section to a tail section;

a single central structural support beam defining, in conjunction with said upper and lower skins, first and second hollow regions within said hollow extrusion;

said nose section defining a first opening contiguous with said first hollow region;

said tail section defining a second opening contiguous with said second hollow region; and said first and second openings being designed and adapted to retain fasteners and being designed to facilitate forming of said openings during extrusion of said blade.

16. The fan blade of claim 15 wherein said blade has a center of mass and said single central structural support beam is placed substantially at the center of mass of said blade.

17. A fan blade comprising:

a hollow extrusion having an upper skin and a lower skin;

each of said skins extending from a nose section to a tail section, said nose section having a leading edge;

said nose section comprising a first longitudinal, extruded groove at said leading edge with a first narrowed open, longitudinally extending mouth;

said tail section comprising a second longitudinal, extruded groove with a second narrowed open, longitudinally extending mouth; and said first and second grooves and said first and second mouths being designed and adapted to retain fasteners within said grooves, and being designed to facilitate forming of said grooves and said mouths during extrusion of said blade.

* * * * *